US006176531B1

(12) United States Patent
Wheeler

(10) Patent No.: US 6,176,531 B1
(45) Date of Patent: Jan. 23, 2001

(54) GRAPPLE SYSTEM

(76) Inventor: Ronald E Wheeler, 1797 Chalybeate Springs Rd., Angier, NC (US) 27501

( * ) Notice: Under 35 U.S.C. 154(b), the term of this patent shall be extended for 0 days.

(21) Appl. No.: 09/192,348

(22) Filed: Nov. 16, 1998

(51) Int. Cl.[7] ..... B66C 1/22
(52) U.S. Cl. ..... 294/88; 294/104; 414/740
(58) Field of Search ..... 294/88, 104, 106, 294/107, 86.4; 414/24.5, 723, 724, 729, 739, 740, 920

(56) References Cited

U.S. PATENT DOCUMENTS

| | | | | |
|---|---|---|---|---|
| 2,875,913 | * | 3/1959 | Gohrke et al. | 294/88 |
| 3,119,637 | * | 1/1964 | Eaves | 294/104 |
| 3,152,706 | * | 10/1964 | Conrad | 294/104 |
| 3,194,421 | * | 7/1965 | Lull | 294/104 |
| 3,203,566 | * | 8/1965 | Kampert et al. | 294/88 |
| 3,356,238 | * | 12/1967 | Aldred | 414/740 |
| 3,637,250 | * | 1/1972 | Blonsky | 294/88 |
| 4,106,646 | * | 8/1978 | Weisgerber | 294/88 |
| 4,280,777 | * | 7/1981 | Gray | 414/739 |
| 5,078,569 | * | 1/1992 | Cook | 414/723 |
| 5,518,359 | * | 5/1996 | Pratt | 414/729 |

FOREIGN PATENT DOCUMENTS

| | | | | |
|---|---|---|---|---|
| 1320-161 | * | 6/1987 | (SU) | 294/104 |

* cited by examiner

*Primary Examiner*—Dean J. Kramer
(74) *Attorney, Agent, or Firm*—Coats & Bennett, PLLC

(57) ABSTRACT

The grapple system of the present invention is intended for use with a front-end loader or other type equipment which specialize in gripping and moving heavy loads. The grapple system includes a stationary jaw assembly that is comprised of a series of spaced apart fingers and which is adapted to be secured to a mounting fixture on the front loading equipment. Rotatably secured to the stationary jaw assembly, by a generally horizontal main shaft, is a movable jaw assembly. Also disposed about the main shaft is a T-shaped lever arm connector, which, along with a pair of hydraulic actuators, comprise an actuating linkage assembly. More particularly, the hydraulic actuators are disposed in a series configuration, with the T-shaped connector serving as an intermediate connecting link between the two actuators. The free end of one actuator is attached to the stationary jaw assembly, while the free end of the remaining actuator is attached in a similar manner to the movable jaw assembly. Hydraulic fluid lines that supply the actuators are connected so as to form a parallel circuit which insures that both actuators operate in unison. The parallel fluid circuit also insures an even or balanced distribution of hydraulic force to both actuators. Consequently, the actuator in the series which is presented with the smallest effective load will be preferentially actuated.

18 Claims, 7 Drawing Sheets

GRAPPLE SYSTEM

FIELD OF THE INVENTION

The present invention relates to grappling systems for securing and lifting heavy cargo or loads, and more particularly to a grappling system that is easily mounted to a front-end loader or other equipment.

BACKGROUND OF THE INVENTION

It has been known to provide a grapple attachment which mounts to the bucket of a front loader-type tractor, such as that previously disclosed in U.S. Pat. No. 4,285,628. Such grapple systems typically include an upper, movable jaw member which is hinged so as to generally pivot or rotate about a horizontal axis between an open and closed configuration relative to the fixed bucket assembly. By swinging from an open to a closed configuration, the movable jaw member is able to trap and pin the target load within the mouth of the bucket. Once securely pinned within the bucket, the load may be lifted and transported to the desired destination.

In previous grapple designs, the actuating mechanism for controlling the position and relative orientation of the movable jaw member with respect to a stationary jaw assembly typically incorporates a direct linkage between a point on the fixed jaw assembly and a corresponding point on the pivoting jaw member. Generally, the direct linkage assembly includes a linear actuating power unit such as a hydraulic cylinder, which is physically located between the fixed jaw assembly and the pivot axis of the movable jaw member. The hydraulic cylinder, being so positioned, is capable of extending and contracting the effective length of the connecting linkage, thereby causing the movable jaw member to generally rotate about the horizontal pivot axis between an opened and closed configuration. As a consequence of this type of connecting linkage and actuation configuration, there are certain orientations of the jaw member which render the actuating mechanism with a very short effective lever arm, and hence very little mechanical advantage. While in such orientations, the resultant force ultimately transferred to the movable jaw member is quite small, because of the short lever arm, and as a consequence large, powerful actuators and associated heavy structural support members are often required to accommodate a broad or full range of grapple jaw movement.

Therefore, with particular regard to grapple assemblies which are adapted to be mounted and secured to a front-end loader or equipment adapted to carry a grapple, there is and continues to be a need for a grappling assembly that incorporates an actuating mechanism which is capable of maintaining a significant mechanical advantage over a broad range of grapple jaw movement, thereby reducing actuating power requirements and actuator related structural requirements.

SUMMARY OF THE INVENTION

The present invention entails a grapple system that includes an attaching frame and a jaw assembly mounted to the attaching frame. The jaw assembly includes a stationary jaw section and a movable jaw section. A shaft interconnects the stationary jaw section with the movable jaw section. There is provided an interconnecting linkage that is connected between the movable jaw section and a fixed point, which in a preferred embodiment is a fixed point associated with the stationary jaw section. The interconnecting linkage includes a pair of hydraulic cylinders interconnected by a rotating connecting link, the rotating connecting link being rotatable about the axis of the shaft that interconnects the stationary jaw with the movable jaw. In order to open and close or move the movable jaw, the hydraulic cylinders are actuated through a hydraulic control system. In the design shown herein, the extension of the two hydraulic cylinders results in the movable jaw being moved towards a closed position while the retraction of the hydraulic cylinders results in the movable jaw being moved towards an open position relative to the stationary jaw. At certain points in the opening and closing cycle, one cylinder may enjoy a more favorable mechanical advantage than another hydraulic cylinder. In such cases, the hydraulic cylinder enjoying the more favorable mechanical advantage will be extended or retracted while the others cylinder may remain, during this portion of the cycle, static, in which case the static cylinder simply serves as a connecting link.

Other objects and advantages of the present invention will become apparent and obvious from a study of the following description and the accompanying drawings which are merely illustrative of such invention.

DETAILED DESCRIPTION OF THE INVENTION

Figure 1:
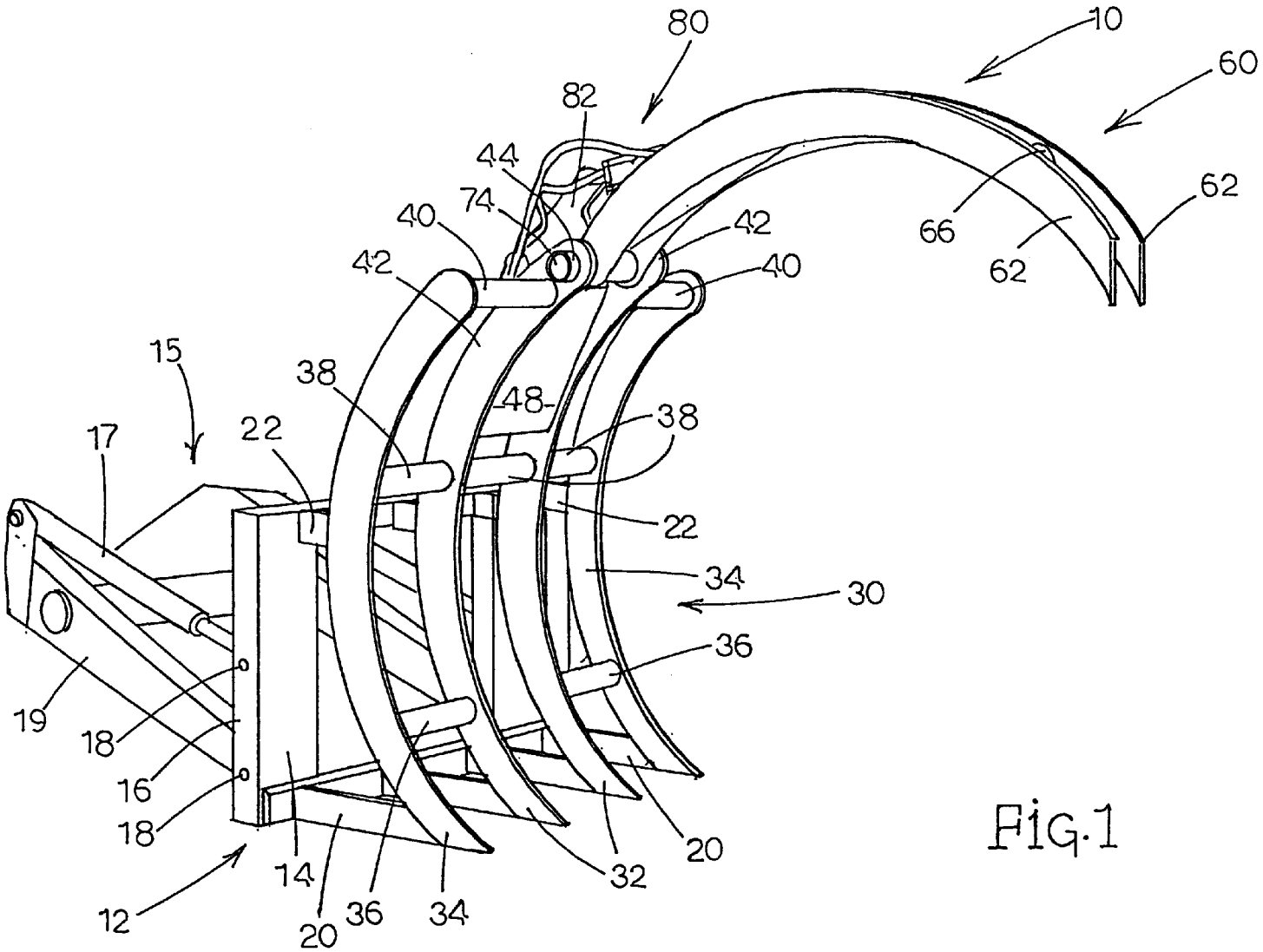
FIG. 1 is a perspective view of the grapple device of the present invention.

Shown in FIG. 1 is a grapple assembly, generally indicated by the numeral 10, for use with a front-end loader or other type of machinery capable of connecting to and supporting the grapple assembly 10. Although the grapple assembly 10 is shown herein mounted to a front-end loader, it will be appreciated that the grapple system 10 can be mounted to various other types of equipment and machinery. Grapple 10 includes a mounting assembly, generally indicated by the numeral 12, which is further comprised of a rectangular main frame structure 14. In the preferred embodiment described herein, the main frame structure 14 is formed of a pair of horizontal steel members and a pair of vertical steel members that are welded together in a manner so as to form a generally open, rectangular structure. Disposed about either side of the rear face of frame 14 are a pair of spaced apart vertically oriented, angle iron mounting brackets 16. Once again, in the preferred embodiment, the mounting brackets 16 are securely bolted to the steel main frame structure 14. Each pair of brackets 16 are generally spaced apart so as to allow for the insertion and attachment of a mounting fixture such as an upper actuating cylinder 17 and lower connecting support arm 19 that forms a part of a conventional front-end loader 15, as illustrated in FIG. 1. More particularly, each bracket 16 includes an upper and lower connecting pin aperture (not shown) which, when aligned with a pair of corresponding apertures disposed in the front-end loader mounting fixture, are each adapted to receive and retain a smooth bore connecting pin 18, thereby generally attaching and securing the overall mounting assembly 12 to the front-end loader.

Figure 6:
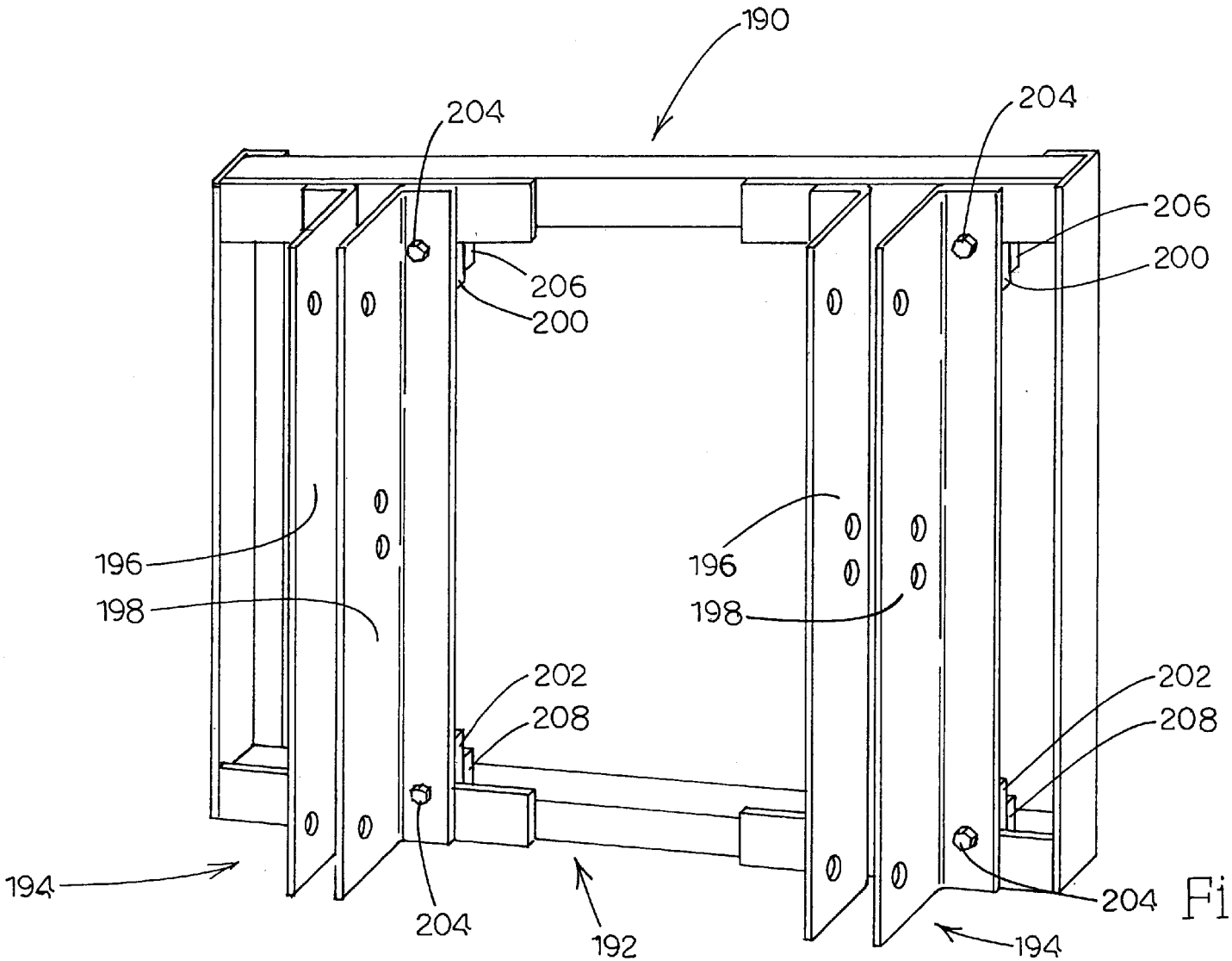
FIG. 6 is a fragmentary perspective review of the grapple illustrating an alternative system for attaching the grapple to a tractor, front-end loader, etc.
Figure 7:
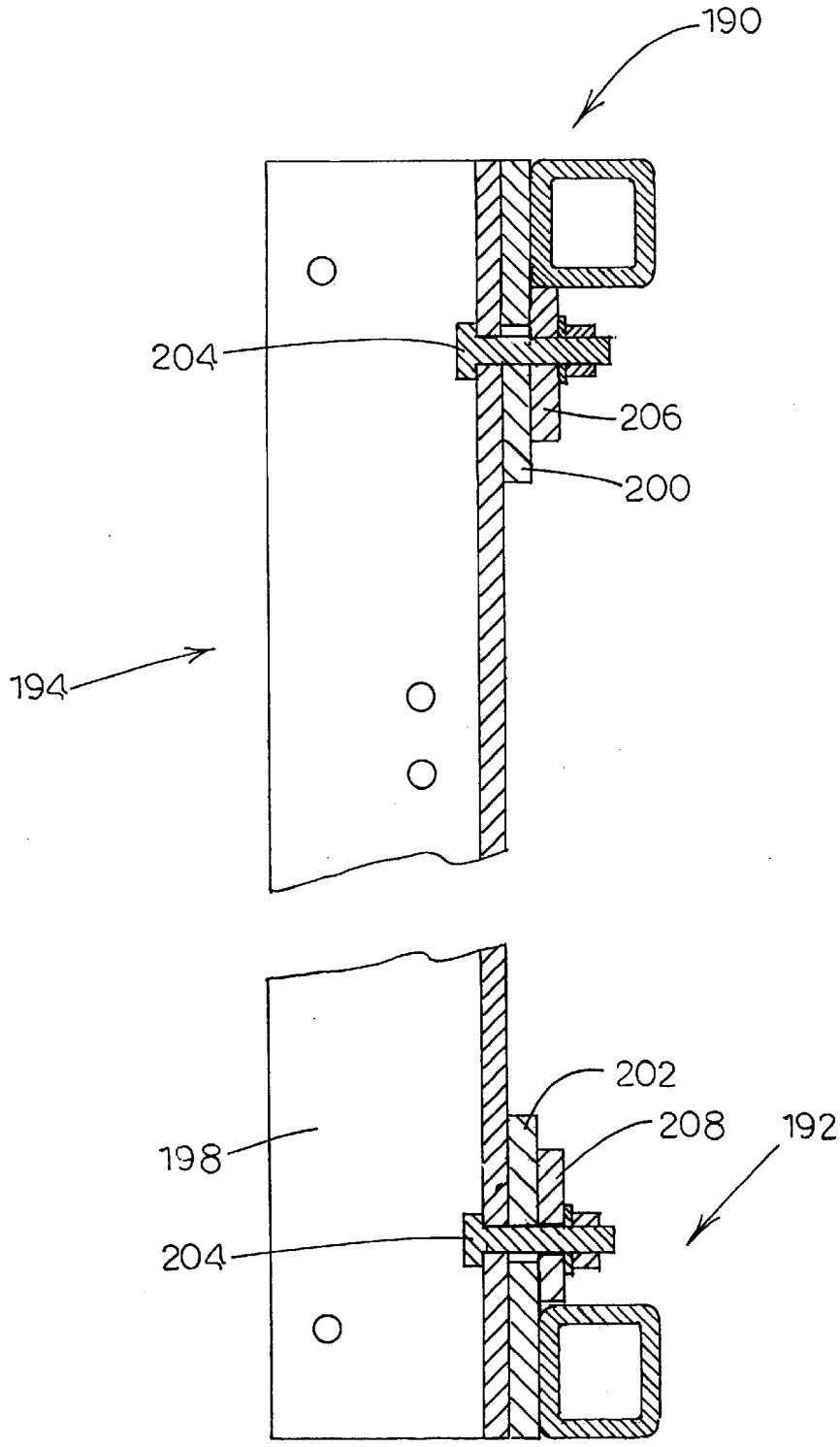
FIG. 7 is a fragmentary sectional view illustrating the alternative attaching system.

Viewing FIGS. 6 and 7, there is shown therein an alternate system for attaching the grapple 10 to a front-end loader or other prime mover. As will be appreciated from reviewing this alternative design, there is an adjustable mounting structure incorporated into the grapple 10 that permits the grapple 10 to be easily and conveniently mounted to a wide variety of different tractors, front-end loaders, and other prime movers. Viewing this alternative design it is seen that the main frame structure of the grapple 10 includes a generally rectangular frame and this rectangular frame includes an upper transverse member 190 and a lower transverse member 192. Secured on opposite sides to transverse members 190 and 192 is an adjustable connector in the form of a bracket set that is indicated generally by the numeral 194. More particularly, the adjustable connector disposed on each side of the grapple 10 comprises a pair of spaced apart angle iron brackets 196 and 198. As seen in the drawings, the angle iron brackets 196 and 198 are spaced apart and extend generally vertically adjacent the back of the main frame structure of the grapple 10. Secured by weldment to each of the angle iron brackets 196 and 198 is an upper block 200 and a lower block 202. Extending through each angle iron bracket 196 and 198 adjacent the blocks 200 and 202 is a bolt assembly 204. The respective bolt assemblies 204 are attached to an upper clamping block 206 that is disposed adjacent the upper block 200 and to a lower clamping block 208 that is disposed adjacent the lower block 202.

In a normal secured relationship, the upper block 200 that is secured to the angle iron brackets 196 and 198 rests directly under the upper transverse member 190 of the main frame structure while the lower block 202 rests atop the lower transverse member 192. The bolt assemblies 204 are pulled tight such that the upper clamping block 206 is pulled tightly adjacent the upper transverse member 190 while the lower clamping block 208 is pulled tightly against the lower transverse member 192. Thus it is seen that the upper and lower transverse members 190 and 192 are effectively sandwiched between the respective clamping blocks 206 and 208 and the angle iron brackets 196 and 198. To adjust the pair of angle iron brackets 196 and 198 on either side of the grapple 10, the respective bolt assemblies 204 are simply loosened and this in turn backs the upper and lower clamping blocks 206 and 208 from the transverse members 190 and 192. This enables the angle iron brackets 196 and 198 to be laterally adjusted with respect to each other and also allows the set of angle iron brackets to be adjusted back and forth on the main frame structure of the grapple 10.

It is appreciated that the angle line brackets 196 and 198 will include one or more sets of connecting holes formed therein that will enable the brackets to be appropriately connected to the connecting structure of a tractor, front-end loader or other type of prime mover. It is contemplated, in order to give the mounting system just described more versatility, that each set of angle iron brackets 196 and 198 would include at least two sets of connecting holes and by simply inverting the brackets 196 and 198 a different set of connecting holes would be properly positioned for connecting to a different tractor, front-end loader or prime mover. By inverting the connecting brackets 196 and 198, it is seen that the lower block 202 essentially becomes the upper disposed block and as such fits underneath the upper transverse member 190 of the main frame structure of the grapple 10. In this alternate attaching system, just described, it is appreciated that the bolt assemblies 204 do not carry any significant or substantial vertical load, as this load is carried by the particular supporting block that is disposed underneath the upper transverse member 190.

Extending generally outwardly and away from the bottom edge of the front face of the main frame structure 14 are a series of four lower connecting plates or runners 20, as shown in FIG. 1. In much the same manner, extending generally outwardly and away from the top edge of the front face of the main frame structure 14 are a series of four upper connecting plates or runners 22. In the embodiment described herein, these lower and upper connecting runners 20 and 22, respectively, are fabricated of a heavy steel plate material and are secured individually to the frame structure 14 by a welding process.

Generally secured to the mounting assembly 12 is grappling or jaw assembly which is comprised of both a stationary jaw member, generally indicated by the numeral 30, and a movable jaw member, generally indicated by the numeral 60. Stationary jaw member 30 includes a series of four spaced apart and generally concave blades or fingers, as shown in FIG. 1. More particularly, stationary jaw member 30 is comprised of a pair of inner concave fingers 32 and a pair of outer concave fingers 34. Each of the four concave fingers is oriented such that the concavity faces outward and generally away from the adjacent main frame structure 14. With particular regard to the main frame structure 14, each of the four concave fingers associated with the stationary jaw member 30 are rigidly and permanently attached to the frame structure 14 via the series of lower and upper connecting runners 20 and 22, respectively. Once again, in the preferred embodiment, these concave fingers are formed of a heavy steel material or the like, and are attached to the upper and lower connecting runners 20 and 22, respectively, via a welding process.

As illustrated in FIG. 1, the relative structural strength and rigidity of the stationary jaw member 30 is enhanced through the use of a series of inter-finger bracing members. More particularly, disposed between each inner finger 32 and it's nearest neighboring outer finger 34 is a lower bracing member 36, an intermediate bracing member 38, and an upper bracing member 40. Also, it will be appreciated from FIG. 1 that an intermediate bracing member 38 is also disposed between the two inner fingers 32. Furthermore, with regard to the intermediate bracing member 38 that is disposed between the two inner fingers 32, it can be seen in FIG. 3 that this particular bracing member includes a clevis tab 50. In the preferred embodiment, these inter-finger bracing members are fabricated from heavy steel tube stock and are generally secured to the exposed side faces of the blade fingers via a welding process. Disposed between the two inner fingers 32, extending from a position just above the intermediate bracing member 38 to a position just below the level of the adjacent upper bracing members 38 is a solid panel 48. In the preferred embodiment, the panel 48 is fabricated from heavy steel plate material and is welded in place between the inner fingers 32, as described above. In general, this steel panel 48 serves as both a structurally supporting member and a protective covering for the actuating elements of the grapple assembly 10.

Figure 4:
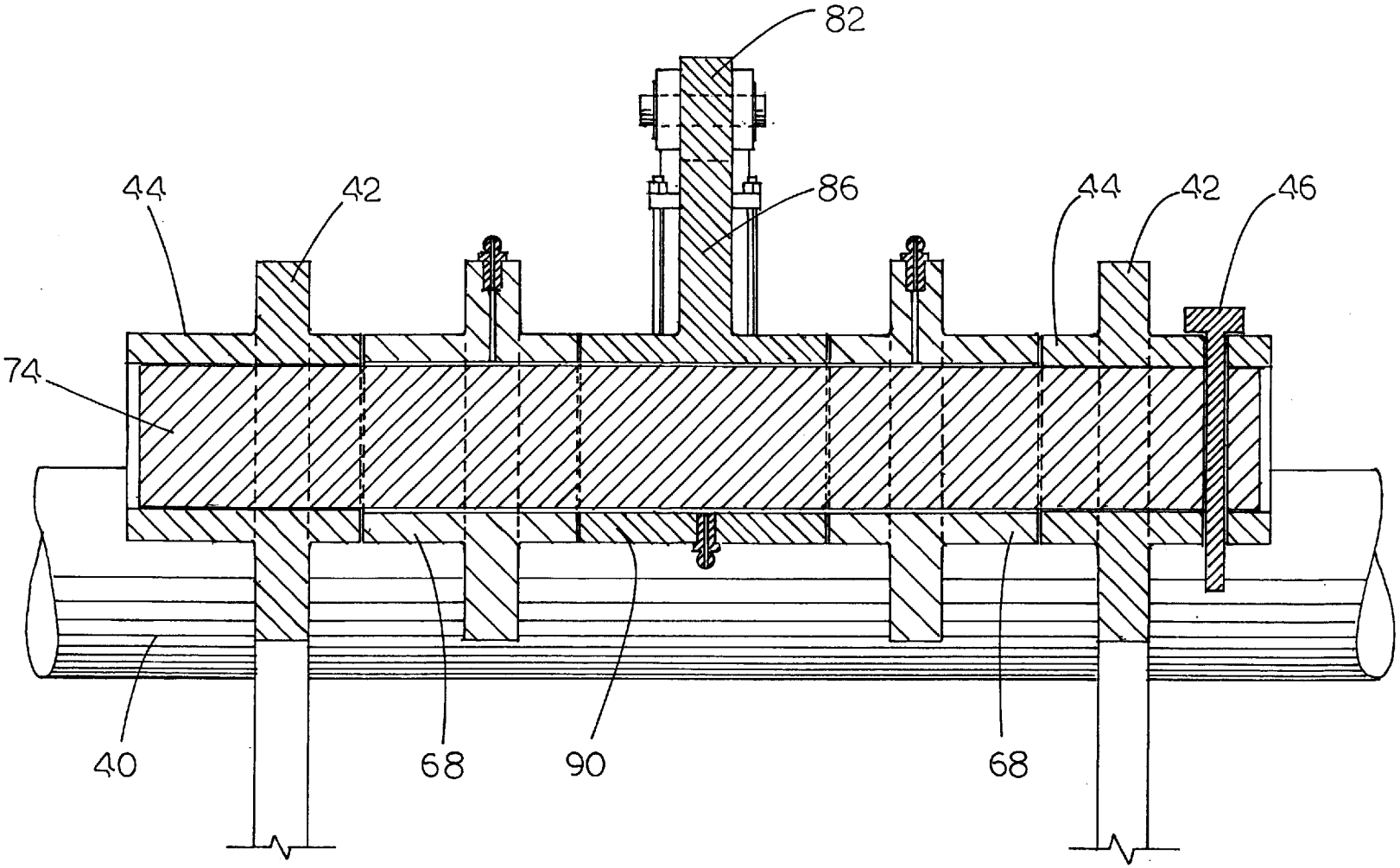
FIG. 4 is a fragmentary transverse sectional view illustrating the inter connecting shaft that connects the stationary jaw section with the movable jaw section of the grapple.

Also, as shown in FIG. 1, the two inner fingers 32 include an extension or extended region 42 at their upper end as compared to the two outer fingers 34. Disposed within the extended region 42 at the top of each inner finger 32 is a shaft throughway or aperture (not shown). Generally aligned with and extending in both directions outwardly and away from the shaft aperture at the top of each inner finger blade 32 is a supporting stub collar 44. In the particular embodiment described herein, the stub collars 44 are formed of heavy steel tubular stock and are secured to the fingers 32 via a welding process. Furthermore, it will be appreciated that the outer most stub collar 44 of one of the two inner fingers 32 is adapted to receive and secure a shaft locking pin 46 (FIG. 4).

As mentioned previously, the second half of the grapple jaw assembly 10 is formed by the movable jaw member 60. Jaw member 60 includes a pair of spaced apart and generally concave blades or fingers 62, as shown in FIG. 1. In a manner similar to that described above for the stationary jaw member 30, the relative structural strength and rigidity of the jaw member 60 is enhanced through the use of a series of inter-finger bracing members. More particularly, disposed in the gap or space between the two fingers 62 is an upper bracing member 64 and a lower bracing member 66. Furthermore, with regard to the upper bracing member 64 that is disposed between the two fingers 62, it can be seen in FIG. 3 that this particular bracing member includes a clevis tab 72.

Also, as shown in FIG. 1, formed in the upper region of each finger 62 is a shaft throughway or aperture (not shown). Generally aligned with and extending in both directions outwardly and away from the shaft aperture at the top of each finger blade 62 is a supporting stub collar 68. See FIG. 4. In the particular embodiment described herein, the stub collars 68 are formed of heavy steel tubular stock and are secured to the finger blades 62 via a welding process.

Disposed between the two spaced apart finger blades 62, extending from a position just above the upper bracing member 38 to a position just below the level of the shaft apertures formed in the upper region of each finger 62 is a solid panel 70. As is the case with the stationary jaw member protective panel 48, the panel 70 is fabricated from a heavy steel plate and is welded in place between the spaced apart fingers 62. Once again, this steel panel 70 serves as both a structurally supporting member and a protective covering for the actuating elements of the grapple assembly 10.

Figure 2:
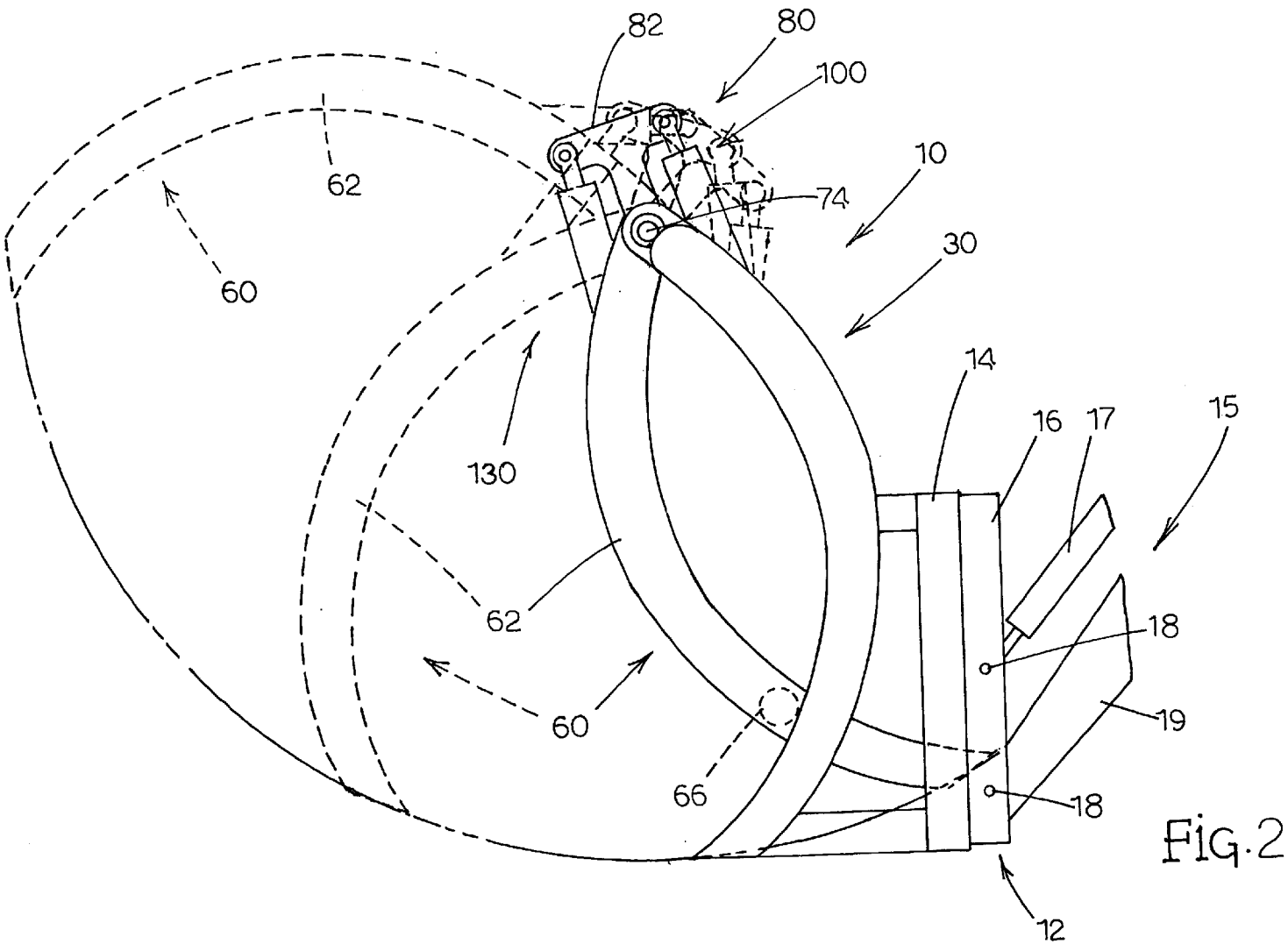
FIG. 2 is a side elevational view of the grapple device shown in full lines in a closed position and shown in a series of dotted lines in various stages of open positions.

The stationary and movable jaw components 30 and 60, respectively, of the grapple jaw assembly as described above are connected and generally secured together in a rotatable or pivoting configuration by a smooth, cylindrical connecting shaft 74, as shown in FIGS. 1, 2 and 4. It will be appreciated that one end of the shaft 74 includes a locking aperture (not shown) that passes transversely therethrough, and which is adapted to receive and secure the associated locking pin 46. When inserted through the associated shaft apertures formed in the stationary jaw fingers 32 and movable jaw fingers 62, the shaft 74 effectively spans the entire distance between the two opposing outer stationary jaw member stub collars 44. In general, the shaft 74 is positioned such that the locking aperture disposed therein is aligned with the corresponding locking aperture in the outer stub collar 44. As such, insertion of the locking pin 46 generally secures the shaft 74 within the grapple jaw assembly and furthermore, prevents rotational movement of the stationary jaw member 30 relative to the shaft 74.

Figure 3:
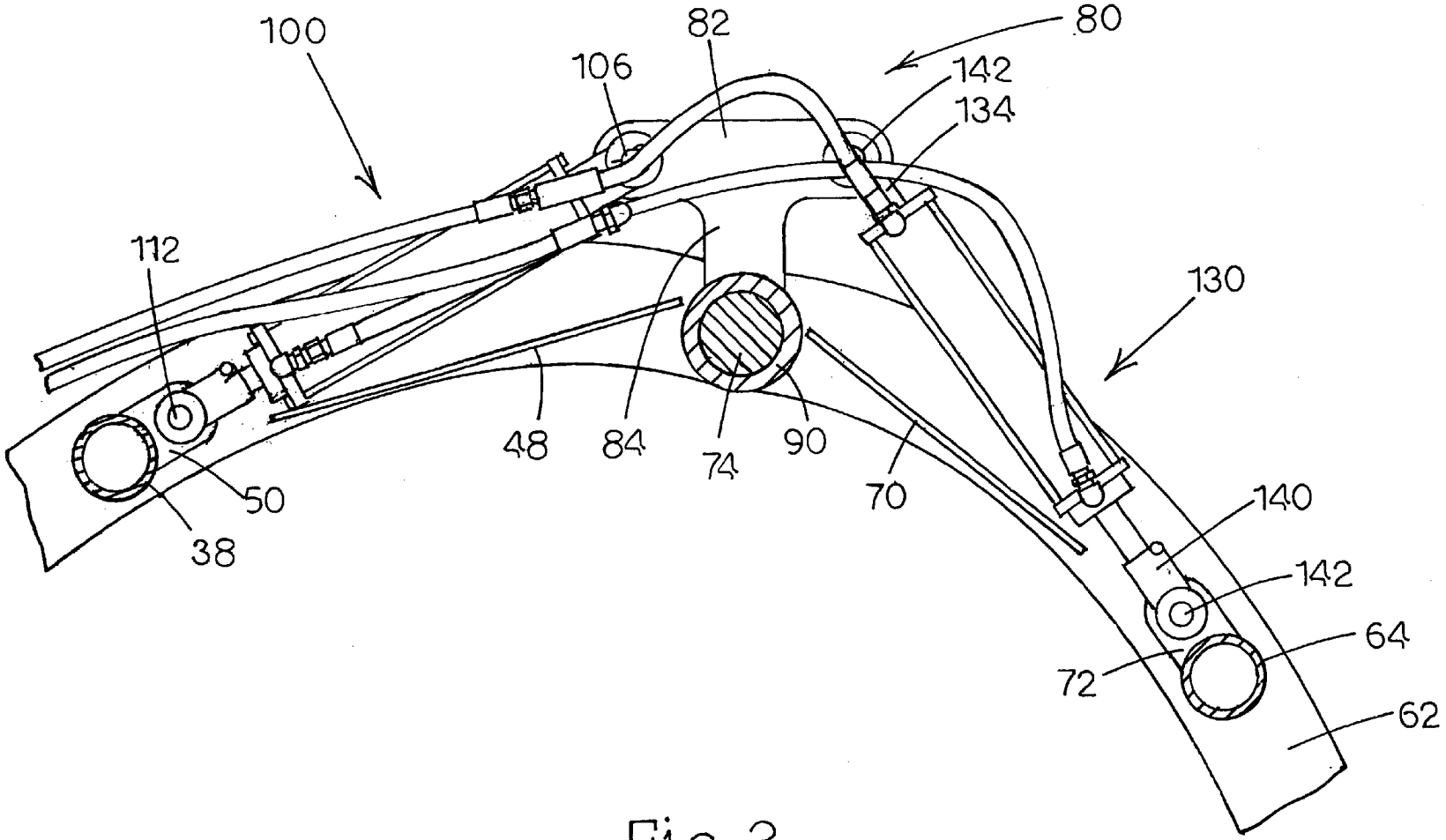
FIG. 3 is a longitudinal sectional view taken through a portion of the grapple device of the present invention.

Also associated with the grapple assembly 10 and more particularly with the jaw assembly is an actuating linkage assembly, generally indicated by the numeral 80. FIGS. 1–3. Actuating linkage assembly 80 includes a generally T-shaped connector 82, and a pair of hydraulic actuators 100 and 130, which are all adapted to be mounted and generally secured to the jaw members as shown in FIGS. 1 and 2. The T-shaped connector 82 further includes a generally vertical lever arm region 84, and a pair of spaced apart connecting apertures (not shown) formed in either end of the horizontal region of the T-shaped connector. Attached to the base of the lever arm region 84 is a hollow, tube-like structure 90, which serves as a collared shaft aperture. Disposed on the side of the tube structure 90 opposite the base of the lever arm 84 is a grease fitting (not shown). As such, the T-shaped connector 82, and more particularly the collared shaft aperture 90, is adapted to be rotatably secured to the shaft 74 in much the same manner as that described above for the stationary and movable jaw members 30 and 60, respectively. More particularly, when properly assembled and positioned on the shaft 74, the connector 82 resides adjacent and generally between the stub collars 68 of the movable jaw member 60, as illustrated in FIGS. 1 and 4.

Disposed generally between the stationary jaw member clevis tab 50 and a connecting aperture of the T-shaped connector 82 is the first hydraulic cylinder or actuator 100, as shown in FIG. 3. As hydraulic actuators of the type contemplated in the embodiment discussed and disclosed herein are well known and commonly employed in similar applications, the description of such actuators provided below is limited in scope to a brief or summary and overview of their basic design and function.

Actuator 100 includes an anchor or base end 102, about which is formed a first clevis-type connector 104 and an arm or rod 108. Actuating rod 108 is slideably mounted or incorporated within the actuator 100 so as to be movable between a generally retracted and generally extended configuration. Disposed about the exposed end of the rod 108 is a second clevis-type connector 110 similar in design and function to the base end clevis 104. See FIGS. 3 and 5.

As shown in FIG. 2, the first hydraulic actuator 100 is adapted to be received and generally secured between the stationary jaw member 30 and the T-shaped connector 82. More particularly, the actuating rod clevis connector 110 of the actuator 100 is received by and rotatably secured to the stationary jaw member clevis tab 50, via a clevis pin 112. In a similar manner, the base or anchor end clevis connector 104 is rotatably mounted to an aperture that is formed in the T-shaped connector 82. Once again, the clevis connector 104 is retained or secured to the connector 82 via a clevis retaining pin 106. As such, a first variable length connecting linkage is effectively formed between the stationary jaw member 30 and the T-shaped connector 82.

Figure 5:
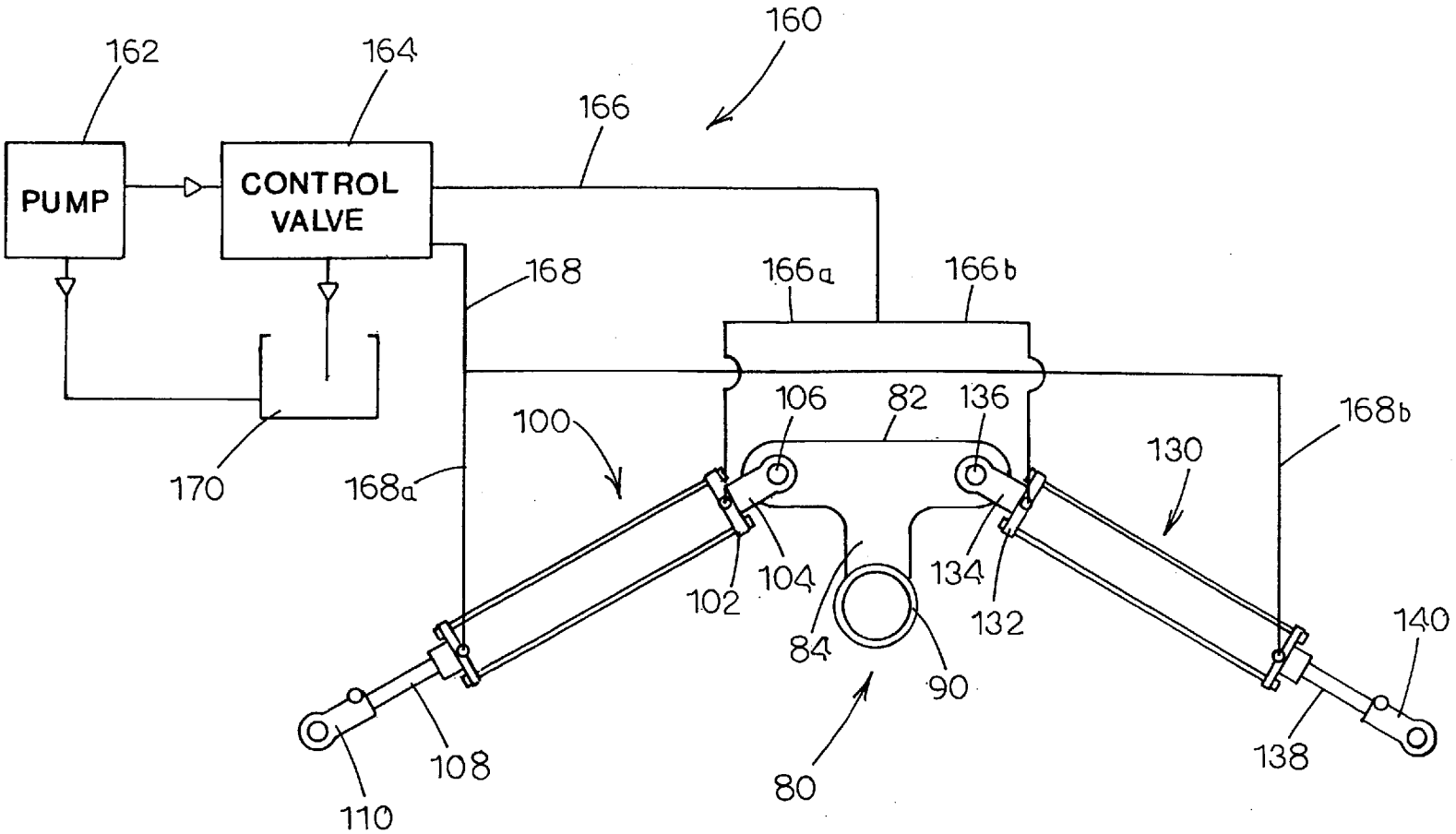
FIG. 5 is a schematic illustration of a hydraulic control system for actuating the grapple device.

In the preferred embodiment, the second actuator 130 is identical in form and function to the first actuator 100, described above. The primary difference or distinction between these two actuators is their location or positioning relative to the T-shaped connector 82 and the associated jaw assembly members 30 and 60. As such, the second actuator 130 includes an anchor or base end 132, about which is formed a first clevis-type connector 134 and associated clevis pin 136, as indicated in FIGS. 3 and 5. Indirectly coupled to the base end 132 via an internal hydraulic piston (not shown) is an actuating arm or rod 138. Actuating rod 138 is slideably mounted or incorporated within the actuator 130 so as to be movable between a generally retracted and generally extended configuration. Disposed about the exposed end of the rod 138 is a second clevis-type connector 140 and clevis pin 142 (see FIG. 3), similar in design and function to the base end clevis 134.

As shown in FIG. 3, the second hydraulic actuator 130 is adapted to be received and generally secured between the movable jaw member 60 and the T-shaped connector 82. More particularly, the actuating rod clevis connector 140 of the actuator 130 is received by and rotatably secured to the movable jaw member clevis tab 72, via the clevis pin 142. In a similar manner, the base or anchor end clevis connector 134 is rotatably mounted to a second connecting aperture that is formed in the T-shaped connector 82. Once again, the clevis connector 134 is retained or secured to the connecting aperture via the clevis retaining pin 142. As such, a second variable length connecting linkage is effectively formed between the movable jaw member 60 and the T-shaped connector 82.

Shown in FIG. 5 is a schematic representation of a hydraulic actuating system, generally indicated by the numeral 160, which serves to provide the pressurized hydraulic fluid that is required for operation or actuation of the associated hydraulic actuators 100 and 130, as described above. As stated previously, with particular regard to the hydraulic actuators, such hydraulic powering systems are well known to those skilled in the art, and they are widely used in a variety of commercial applications. Consequently, a detailed discussion of the theory and operation of such hydraulic power systems will not be provided herein.

With particular regard to the actuating linkage assembly 80 employed in the present embodiment, the hydraulic system 160 includes a hydraulic pump 162 and a multi-position fluid control valve 164. Extending from the hydraulic control valve 164 is a pair of main hydraulic lines 166 and 168. Line 166 splits at a tee to form lines 166*a* and 166*b* which connect to the anchor ends 102 and 132 of the hydraulic cylinders 100 and 130 respectively. Line 168 tees and splits into lines 168*a* and 168*b* which connect to the rod ends of the cylinders 100 and 130. Further the control valve 164 is coupled to a hydraulic reservoir 170 which in turn is connected to the hydraulic pump 162. To extend the cylinders 100 and 130, the control valve 164 is appropriately actuated such that fluid is directed through line 166 and therefrom into lines 166*a* and 166*b*. This causes the rods 108 and 138 to be extending from their respective hydraulic cylinders. At the same time, hydraulic fluid is expelled from the cylinders 100 and 130. More particularly, as fluid is being directed into the anchor ends of the cylinders 100 and 130, fluid is being directed out the rod ends of the same cylinders via lines 168*a*, 168*b* and 168 and directed back to and through the control valve and into the reservoir 170. To retract the cylinders 100 and 130, the reverse process takes place. That is, fluid is directed into the cylinders through the rod ends and at the same time fluid is expelled from the cylinders through the anchor ends and the expelled fluid is returned to the control valve and back to the reservoir 170.

In the embodiment discussed herein, the grapple system 10 is shown mounted to a front-end loader 15. The front-end loader 15 would typically include its own hydraulic system, including the pump 162 and the control valve 164. Thus, the hydraulic cylinders 100 and 130 would be simply connected to the hydraulic system of the front-end loader 15. However, the grapple system 10 could be provided with its own hydraulic system.

At this point, it should be noted that in the preferred embodiment of the invention disclosed herein, it is assumed that the grapple assembly is used primarily as an attachment for a conventional front-end loader or other machine. More particularly, it is also assumed that once attached to a front-end loader the grapple assembly 10 can be used to facilitate the gripping and transport of many types of objects such as, for example, rolled bales of hay. It will therefor be appreciated that the specific crescent contour or concave nature of the grapple fingers described above is intended for the efficient gripping and manipulation of all types and shapes of objects typically transported by grapple systems. As such, it should be apparent that the grapple assembly of the present invention is not limited to use with crescent or concave shaped grapple fingers, and in fact, the particular shape of the grapple fingers may be customized to accommodate a variety of gripping or manipulating tasks.

In the embodiment illustrated, installation of the grapple system 10 of the present invention first involves positioning and generally aligning the grapple mounting assembly 12 with the cylinders 17 and arms 19 of the front-end loader 15, such that the mounting brackets 16 may be secured to the mounting fixture via the connecting pins 18. The hydraulic fluid lines 166 and 168 are then connected to the control valve unit 164 of the hydraulic power system 160. As noted above, the hydraulic power system 160 located on the front loader can be used to power a variety of accessories, in addition to the grapple system 10 of the present invention.

Turning now to a brief discussion of the operational mechanics of the grapple system 10 of the present invention, it will be appreciated that the actuating linkage assembly 80, as described above, provides a pair of hydraulic actuators 100 and 130 that are connected in a series configuration about the T-shaped lever arm connector 82, and which function in a cooperative manner to manipulate the relative orientation of the movable jaw member 60 with respect the associated stationary jaw member 30.

Beginning with the grapple jaw assembly in a fully closed configuration, as shown in full lines in FIG. 2, it will be appreciated that the fingers 62 of the movable jaw member 60 are more closely spaced than the adjacent stationary jaw fingers 32, and as such the movable fingers 62 can be effectively tucked into and generally through the stationary jaw member 30. In this fully closed position, both the first and second actuators 100 and 130, respectively, are in a fully extended configuration. That is, the hydraulic control valve 164 is configured such that a pressurized volume of fluid, provide by the pump 162, is generally directed into and through line 166 and the individual lines 166*a* and 166*b*. This causes the pistons within the respective cylinders 100 and 130 to be extended. As the cylinders 100 and 130 are extended, it follows that the hydraulic fluid formally in the cylinders is expelled through lines 168*a* and 168*b* and 168. The expelled fluid moves from these lines back to the control valve where the fluid flows into the reservoir 170. It is appreciated that the hydraulic system 160 illustrated in FIG. 5 is simply one example of a suitable system and that other systems having different components, controls and flow schemes could be employed.

From the brief discussion provided above regarding the basic operation of the hydraulic system 160 and the associated actuators 100 and 130, it will be appreciated that as a result of the parallel hydraulic circuit configuration, the actuators will always extend or retract in unison. That is, both actuators will either extend simultaneously or retract simultaneously. It is not possible for one actuator to extend while the other simultaneously retracts. An additional consequence of the parallel hydraulic circuit configuration involves the hydraulic force levels that are experienced by the actuators. More particularly, as a result of the parallel hydraulic circuit, the force applied to each actuator will always be approximately identical. That is during the closing of the grapple system 10, the hydraulic system will be directing fluid to the anchor ends of the two cylinders 100 and 132. The pressure of the fluid found in lines 166*a* and 166*b* will be generally equal and consequently the pressure acting on the individual pistons in each cylinder will be generally equal.

Thus, it will become apparent from the brief discussions that follow, that a significant benefit of an actuating linkage assembly which utilizes multiple hydraulic actuators in series and a parallel hydraulic circuit arrangement, involves the inherent ability of the two series configured actuators to distribute the applied hydraulic force between themselves in a balanced and consequently efficient manner. This balanced distribution of force is driven or effected primarily by the effective load experienced by each actuator in the linkage series.

It will be further appreciated by those skilled in the art that the effective loads experienced by each hydraulic actuator 100 and 130 in the actuating linkage assembly 80 of the present invention are closely related to both the gross load presented to the grapple jaw assembly and the mechanical advantage realized or attained by each actuating link. With regard to the issue of mechanical advantage, the orientation of the T-shaped connector 82 and its associated lever arm 84 relative to the stationary and movable jaw members 30 and 60, respectively, is the primary determinant of the mechanical advantage realized by each of the actuating links. As the T-shaped connector 82 is free to rotate about the pivot axis defined by the shaft 74, extension or retraction of one or both of the cylinder links tends to alter the relative orientation of the connector 82 with respect to the adjacent jaw members. Furthermore, given that the base and actuating rod clevis connectors 104 and 110 associated with the first hydraulic actuator 100 and the base and actuating rod clevis connectors 134 and 140 associated with the second hydraulic actuator 130 are all free to generally pivot about their respective attachment points, the relative orientation of the connector 82 during actuation also tends to change with respect to the actuating links themselves. The results of such dynamic changes in the relative orientation between the T-shaped connector 82 and the associated actuators 100 and 130 during the actuation process are corresponding variations in the mechanical advantages realized by the two actuating linkages. Thus, the mechanical advantages realized by each of the two series connected hydraulic actuators 100 and 130 varies as a function of the position assumed by the movable jaw 60.

It will be further appreciated that, from an operational mechanics standpoint, a longer lever arm 84 will generally provide the actuating linkages with the opportunity to develop a greater mechanical advantage over an applied load, while a shorter lever arm 84 will generally provide for a greater range of jaw motion at the expense of mechanical advantage. Without going into a detailed discussion of the subject, it will be appreciated by those skilled in the art that the attachment points of the first and second actuator clevis connectors 110 and 140, respectively, will also play a role in determining both the range of jaw motion and the range of mechanical advantages that may be achieved by either actuator.

Given the discussion of general operating principles presented above, it will be appreciated that as the grapple jaw assembly 10 of the present invention is moved from the closed position to a generally open position the first and second actuators 100 and 130, respectively, are retracted in a manner such that the actuating link with the combination of applied load and mechanical advantage that results in the smallest effective actuator load is preferentially actuated. Expressed in another way, the actuator that experiences the least load is active. In the event that the effective loads experienced by both the first and second hydraulic actuators are equal, then it is possible that both actuators may be actuated simultaneously. To reiterate, regardless of the relative positions of the two jaw members 30 and 60, and regardless of whether the grapple jaw assembly is being opened or closed, the sequence of actuation of the first and second actuators 100 and 130, respectively, is determined solely by the effective loads experienced by each actuator. In general, the actuator experiencing the smallest effective load at any given instant will continue to actuate, either extending or retracting, until such time as the other actuator in series is experiencing a smaller effective load. At such time, actuation will transition or transfer smoothly from the actuator experiencing the larger effective load to the actuator experiencing the smaller effective load. This inherent, self-regulating behavior ultimately results in the ability to achieve a smooth and continuous movement of the jaw member 60 through a wide range of jaw configurations or positions.

One significant advantage of the grapple system 10 is its inherent load carrying capacity and the range of movement of the movable jaw 60. Note in FIG. 2, for example, the size of the mouth defined between the outer extremities of the stationary jaw 30 and the movable jaw 60 when the movable jaw is disposed in the fully open position. Such a mouth opening will enable the grapple system 10 to retrieve a wide variety of vary large objects, such as, for example, a large round bale of hay. From the fully open position, the movable jaw 60 can be rotated counter clockwise, as viewed in FIG. 2, until it intercepts with and even passes through the frame structure of the stationary jaw 30. This range of movement enables the grapple system 10 to also retrieve and carry very small objects.

The wide range of movement found in the movable jaw 60 is due to the actuating linkage assembly 80 and how the actuating linkage assembly is incorporated into the grapple system 10 as a whole. As seen in the drawings, effectively the actuating linkage 80 comprises three main connected components, the hydraulic cylinders 100 and 130 and the connector 82. Effectively the linkage assembly 80 wraps around the upper outer portions of the grapple system 10. In the closed position, as shown if full lines in FIG. 2, it is seen that the hydraulic cylinder 100 extends generally upwardly from the stationary jaw 30 and connects to the T- shaped connector 82. Likewise, the other cylinder, hydraulic cylinder 130, extends generally upwardly from the movable jaw 60 and connects to the opposite side of the connector 82. Thus, the entire linkage assembly 80 tends to wrap around the grapple system 10. As seen in FIG. 3, note that the hydraulic cylinders 100 and 130 connect to the tee connector 82 at a point above the axis of the shaft 74.

Also, note the point where the hydraulic cylinder 130 attaches to the movable jaw 60. That is, the hydraulic cylinder does not attach at a point relatively close to the connecting shaft 74 but connects to the movable jaw 60 at intermediate point thereon which is spaced outwardly of the shaft 74. Thus, the movable jaw 60 is being moved and articulated at a point spaced substantially outwardly from the central connecting shaft 74.

Herein the grapple system is referred to as including a movable jaw that is movable between open and closed positions. This only means that the movable jaw section 60 is movable back and forth between two different positions and is not meant to imply that the movable jaw 60 has to move between fully open and closed positions. Thus, reference to open and closed positions means only partially open or closed.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended Claims are intended to be embraced therein.

What is claimed is:

1. A grapple system comprising:

a. an attaching frame;

b. a jaw assembly mounted to the attaching frame and including a stationary jaw section and a movable jaw section;

c. the movable jaw section being secured about a pivot axis and movable back and forth relative to the stationary jaw section between open and close positions;

d. an actuated linkage assembly connected to the movable jaw section for moving the movable jaw section between open and close positions; and e. the actuating linkage assembly including:

(1) a connecting link rotatively mounted about the pivot axis and movable back and forth about the pivot axis;

(2) a first hydraulic cylinder having one end connected to the connecting link and a second end anchored with respect to the movable jaw section;

(3) a second hydraulic cylinder having one end connected to the connecting link and a second end connected to the movable jaw section;

(4) wherein the selected actuation of the hydraulic cylinders causes the movable jaw section to move between open and closed positions and in the process results in the connecting link rotating about the pivot axis;

(5) wherein he hydraulic cylinders are arranged to extend to close the grapple system and to retract to open the grapple system;

(6) wherein both hydraulic cylinders act under pressure during opening and closing of the grapple system but wherein both hydraulic cylinders may not at all times be extended or retracted simultaneously because at some instances during the opening and closing of the grapple system one cylinder may enjoy a more favorable mechanical advantage over the other and consequently during certain periods of opening or closing one cylinder may be extending or retracting while the other cylinder is not extending or retracting; and f. wherein the stationary jaw section and the movable jaw section include individual fingers and wherein the hydraulic cylinders are connected at points between the respective fingers of the stationary and movable jaw sections.

2. The grapple system of claim 1 wherein the second hydraulic cylinder extends from the connecting link to an intermediate point on the movable jaw.

3. The grapple system of claim 1 including a shaft interconnecting the stationary jaw section with the movable jaw section and wherein the shaft forms the pivot axis about which the connecting link rotates, and wherein the connecting link is rotatable about the axis of the shaft and is connected between the first and second hydraulic cylinders, and wherein the second hydraulic cylinder extends from the connecting link to an intermediate point on the movable jaw section where it connects to the movable jaw section.

4. The grapple system of claim 3 wherein the first hydraulic cylinder is anchored to the stationary jaw section.

5. The grapple system of claim 1 wherein intermediate fingers of the stationary jaw section are extended upwardly and are provided with align apertures for receiving a shaft that interconnects the stationary jaw section with the movable jaw section.

6. The grapple system of claim 5 wherein the shaft is fixed relative to the stationary and movable jaw sections and wherein the connecting link is journaled about the shaft and extends outwardly therefrom for interconnecting the first and second hydraulic cylinders.

7. The grapple system of claim 6 wherein the movable jaw section includes a pair of fingers with each finger being journaled about the shaft, and wherein the connecting link is interposed between the pair of fingers of the movable jaw section and is rotatable about the shaft between the pair of fingers of the movable jaw and wherein the connecting link is rotatable about the shaft independently of the movable fingers.

8. The grapple system of claim 7 wherein the connecting link assumes a generally T-shape having an upper cross connector that interconnects the two hydraulic cylinders.

9. The grapple system of claim 1 wherein the movable jaw section is movable to a position where it intersects with the stationary jaw section.

10. The grapple system of claim 1 wherein the attaching frame includes an attaching structure that is laterally adjustable in order that the grapple system may be connected to different connecting structures.

11. The grapple system of claim 10 wherein the attaching structure include series of bracket connectors that are slidable back and forth on a frame structure that forms a part of the grapple system.

12. The grapple system of claim 11 wherein the frame structure includes upper and lower transverse members, and wherein each bracket connector includes a pair of spaced apart blocks secured thereto wherein at least one of the blocks in a connected mode rests under the upper transverse member, and wherein each connector bracket includes a pair of clamping blocks that are secured to the connecting bracket by a pair of bolt assemblies and wherein the clamping blocks act to secure the connecting bracket about the upper and lower transverse members.

13. A grapple system comprising:

a. a stationary jaw;

b. a movable jaw movable back and forth relative to the stationary jaw;

c. a shaft interconnecting the movable jaw with the stationary jaw;

d. a connecting link rotatable about the axis of said shaft and movable back and forth about the axis of the shaft;

e. a first hydraulic cylinder connected to the connecting link and extending therefrom with a first end portion of the first hydraulic cylinder being connected to the connecting link while a second end portion of the first hydraulic cylinder is fixably secured relative to the interconnecting shaft;

f. a second hydraulic cylinder connected to the connecting link and extending therefrom towards the movable jaw wherein an end portion opposite the end portion connected to the connecting link is connected to the movable jaw, thereby forming an actuating connecting linkage comprise of the two hydraulic cylinders and the connecting link; and g. the first and second hydraulic cylinder being connected to a common hydraulic control valve that upon actuation furnishes fluid under pressure to each cylinder such that the cylinders are actuated in unison or separately depending on the effective load experienced at any one time by the respective hydraulic cylinders, wherein the effective load is a function of both actual load and the mechanical advantage experienced by the respective cylinders, thereby permitting one hydraulic cylinder to be actuated while the other hydraulic cylinder is inactive and visa versa.

14. The grapple system of claim 13 wherein the first hydraulic cylinder is anchored to the stationary jaw and extends generally upwardly therefrom to connect with the connecting link, and wherein the actuating linkage comprised of the hydraulic cylinders and the connecting link effectively extends over and to some extent partially wraps around the shaft when the movable jaw assumes certain positions with respect to the stationary jaw.

15. The grapple system of claim 14 wherein the movable jaw is movable to a position where it intersects with the stationary jaw.

16. The grapple system of claim 14 wherein the actuating linkage is configured such that the extension of the hydraulic cylinders results in the grapple system moving toward a closed position while the retraction of the cylinders results in the grapple system moving towards an open position.

17. The grapple system of claim 16 wherein the connecting link extends outwardly away from the shaft and forms a lever arm that interconnects the two hydraulic cylinders.

18. A method of actuating and controlling a grapple having a stationary jaw and a movable jaw interconnected through a shaft, comprising:

a. rotatably mounting a connecting link about the axis of the shaft;

b. interconnecting a first hydraulic cylinder between the connecting link and a fixed point such that the first hydraulic cylinder extends generally on the stationary jaw side of the shaft;

c. interconnecting a second hydraulic cylinder between the connecting link and a point on the movable jaw such that the second hydraulic cylinder extends generally on the movable jaw side of the shaft; and d. extending and retracting the hydraulic cylinders to generally open and close the grapple; and e. connecting each of the hydraulic cylinders to a common control valve and effectively alternating the operation of each hydraulic cylinder depending on the effective load experienced at any one time by the respective hydraulic cylinders, wherein the effective load is a function of both actual load and the mechanical advantage experienced by the respective cylinders, such that at any one time the hydraulic cylinder experiencing the least effective load will be actuated while the hydraulic cylinder experiencing the greatest effective load will remain inactive.

* * * * *